US005425659A

United States Patent [19]

Banks

[11] Patent Number: 5,425,659

[45] Date of Patent: Jun. 20, 1995

[54] MULTIPLE ELECTRICAL OUTLET STRIP MODULE

[75] Inventor: Charles A. Banks, Mt. Laurel, N.J.

[73] Assignee: SL Waber, Inc., N.J.

[21] Appl. No.: 901,782

[22] Filed: Jun. 22, 1992

[51] Int. Cl.[6] ..... H01R 25/00

[52] U.S. Cl. ..... 439/650; 439/505

[58] Field of Search ..... 439/638, 650, 651, 652, 439/505, 106, 107

[56] References Cited

U.S. PATENT DOCUMENTS

| | | | |
|---|---|---|---|
| 2,609,414 | 9/1952 | Weisberg | 439/650 |
| 3,478,295 | 11/1969 | Grieshaber | 439/650 |
| 4,072,401 | 2/1978 | Instone | 339/125 R |
| 4,113,334 | 9/1978 | Instone | 339/22 R |
| 4,493,515 | 1/1985 | Banks | 339/14 L |
| 4,830,626 | 5/1989 | Liu | 439/650 |
| 4,979,907 | 12/1990 | Lee | 439/214 |
| 5,137,474 | 8/1992 | Lin | 439/650 |

*Primary Examiner*—David L. Pirlot
*Attorney, Agent, or Firm*—Nixon & Vanderhye

[57] ABSTRACT

A module for use in a multiple electrical outlet strip, and the strip itself, are provided which are easy to assemble, in which the components are positively held in place, and which may be constructed of a wide variety of materials. The module includes first and second integral molded plastic components which receive positive, negative, and ground bus bars within them, the bus bars being positively held in place by projections formed on the first and second molded components. The ends of the bus bars are connected to electrical wires. The first and second module components are held together by screws. The electrical outlet receptacles formed by the module are inserted into receiving openings in the top part of a casing for an electrical outlet strip. The top and bottom portions of the casing normally are of metal. The module is held to the upper portion of the casing by screws.

17 Claims, 2 Drawing Sheets

MULTIPLE ELECTRICAL OUTLET STRIP MODULE

BACKGROUND AND SUMMARY OF THE INVENTION

Multiple electrical outlet strips are versatile and commonly used electrical components which are practical in a wide variety of environments. Multiple electrical outlet strips typically comprise a plurality of electrical outlet receptacles, each having a plurality of electrical plug receiving openings therein (typically three openings, one for a negative plug prong, another for a positive plug prong, and a third for a ground plug prong). In most conventional multiple electrical outlet strips, such as shown in U.S. Pat. Nos. 4,493,515, 4,113,334 and 4,072,401, each electrical outlet receptacle is distinct from the others, requiring them to be individually assembled in the exterior casing for the multiple electrical outlet strip. There have been proposals for providing a number of receptacles so that they are integral with each other, and then mounting them to projections on the bottom of the casing for the multiple electrical outlet strip, such as in U.S. Pat. No. 4,979,907. However such a construction requires mounting of the components to the bottom portion of the casing, which may be undesirable in some circumstances, and which can limit the materials of which the casing is constructed.

According to the present invention a module for use in a multiple electrical outlet strip, and a multiple outlet strip itself, are provided which are extremely easy to assemble in a quick and inexpensive manner, with the module positively held in place within the multiple electrical outlet strip. The component parts are also easy to mold and construct, and may be made of a wide variety of materials; for example, the casing may be made of metal or electrical insulating material, whichever is desired.

According to one aspect of the present invention, a module for use in a multiple electrical outlet strip is provided. The module comprises the following components: A first integral molded component of electrically insulating material having a top face defining a plurality of series of electrical plug receiving openings disposed in line in a first direction. A second integral molded component of electrically insulating material having a bottom face, and a top face opposite the bottom face, and having a length, in the first direction, approximately as long as the first molded component. A plurality of bus bars of electrically conducting material disposed between the first and second molded components, cooperating with the electrical plug receiving openings, each bus bar having an end termination accessible from the exterior of one end of the molded components in the first direction. And, means for securing the first and second molded components together, holding the bus bars in a fixed position with respect to the plug receiving openings.

The module also preferably comprises integral positioning projections formed on the first molded component for positively positioning the bus bars in fixed position with respect to the plug receiving openings. Each of the plurality of series of electrical plug receiving openings preferably comprises three openings, one each for positive, negative, and ground electrical plug prongs. The plurality of bus bars thus comprises three bus bars, negative, positive, and ground bus bars. A plurality of integral hollow projections may be formed on a second molded component and extending upwardly from the top face thereof, and the ground bus bar may have means defining a plurality of openings in it for receipt of the hollow projections (which may be parallelepipeds), the projections stabilizing the position of the ground bus bar. Each bus bar also has portions thereof that preferably extend outwardly from one end of the first and second molded components, and have surface manifestations (e.g. holes) associated with them for receipt of wires from an electrical cord.

The securing means for holding the first and second molded components together may comprise a plurality of threaded fasteners (screws) extending through the bottom face of the second molded component and engaging the first molded component. The first and second molded components may be injection molded of plastic, and the bus bars may be brass, copper, or aluminum. A plurality of screw receiving openings may be formed on the face of the first molded component for connecting the module to an upper surface of a casing for a multiple electrical outlet strip.

The invention also relates to a multiple electrical outlet strip comprising a casing including a casing top portion, and a casing bottom portion. The casing top portion has an upper surface with means defining a plurality of in line openings, each receiving an electrical outlet receptacle, in turn for receipt of an electrical plug. The electrical outlet receptacles may comprise a module as described above, and connecting means are provided for connecting the module to the upper surface of the casing, the connecting means typically comprising screws extending into screw threaded openings in the module upper surface. The casing top and bottom portions, which both may be made of metal, completely contain the module within them, with the electrical outlet receptacles extending outwardly from the casing top portion upper surface.

The invention also comprises a multiple electrical outlet strip comprising: A casing including a casing top portion, and a casing bottom portion, the casing top potion having an upper surface with means defining a plurality of openings, each for receipt of an electrical outlet receptacle, for receipt of an electrical plug therein. A module of electrically insulating material comprising a plurality of integrally formed and connected electrical outlet receptacles, each receptacle having means defining a plurality of electrical plug prong receiving openings therein. A plurality of bus bars of electrically conductive material associated with the module plug prong receiving openings, one bus bar for each prong receiving opening of an electrical receptacle. And, connecting means for connecting the module to the upper surface of the casing, the casing top and bottom portions completely containing the module therewithin, with the electrical outlet receptacles extending outwardly from the upper surface. The casing lower portion may be flat, free of projections, which allows it to be made of metal. The connecting means may comprise a plurality of externally threaded fasteners (screws) and means defining a plurality of through-extending openings in the case top portion upper surface, and means defining a plurality of aligned internally screw threaded openings in the module for receipt of the screw.

It is the primary object of the present invention to provide an inexpensive and easy to assemble multiple electrical outlet strip in which the components are positively held in place, and which has a casing that may be made entirely of metal if desired. This and other objects of the invention will become clear from an inspection of the detailed description of the invention, and from the appended claims.

DETAILED DESCRIPTION OF THE DRAWINGS

Figure 1:
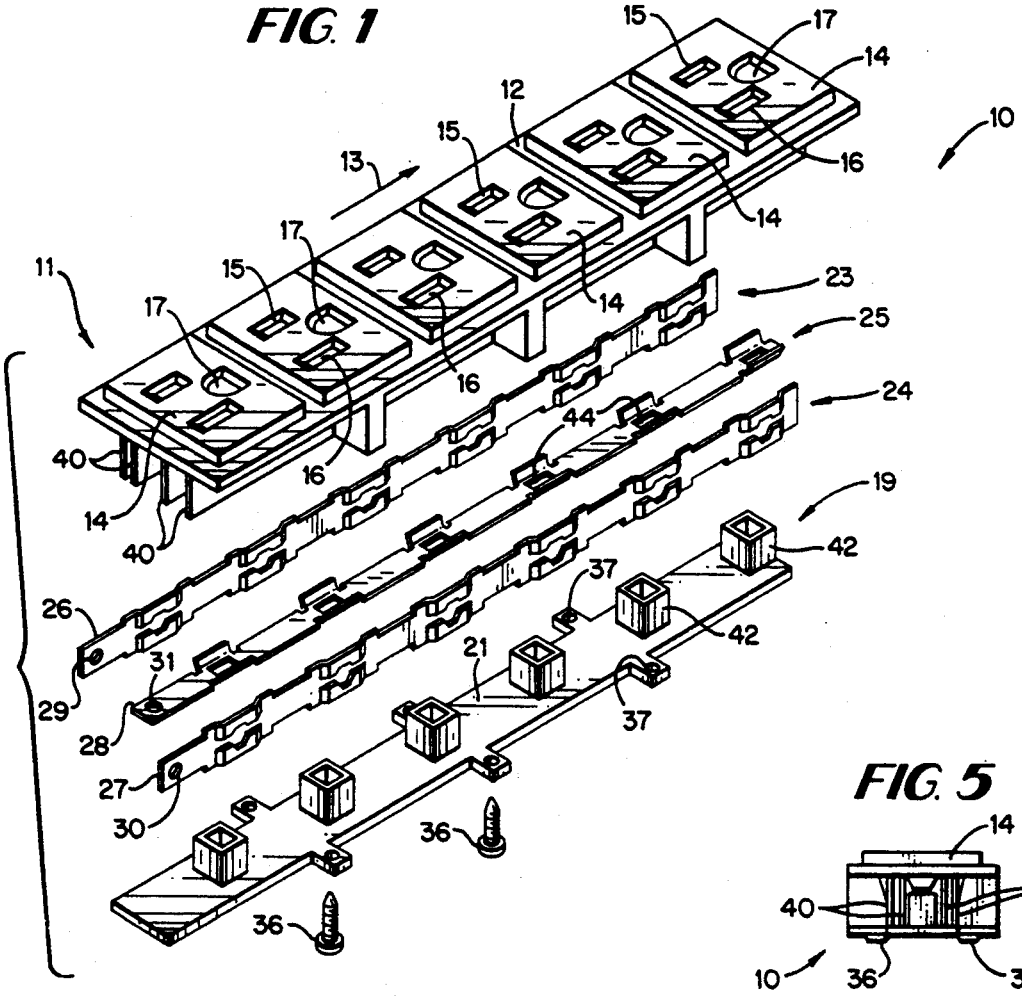
FIG. 1 is a top perspective exploded view of an exemplary module according to the present invention.
Figure 5:
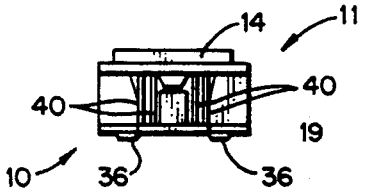
FIG. 5 is a front end view (opposite the electrical wires) of the module of FIGS. 2 through 4.
Figure 2:
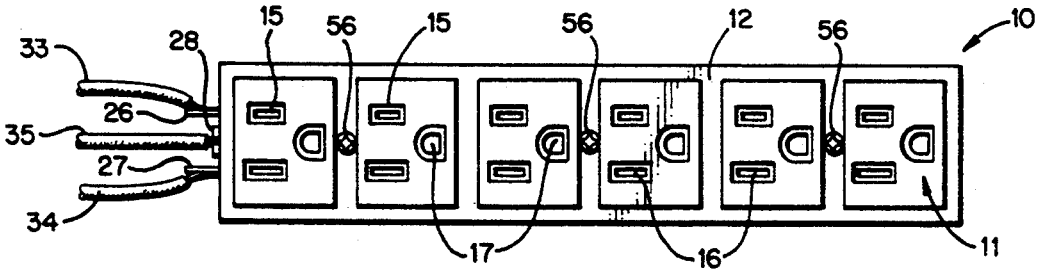
FIG. 2 is a top plan assembled view of the module of FIG. 1, shown connected to an electrical cord wires.
Figure 3:
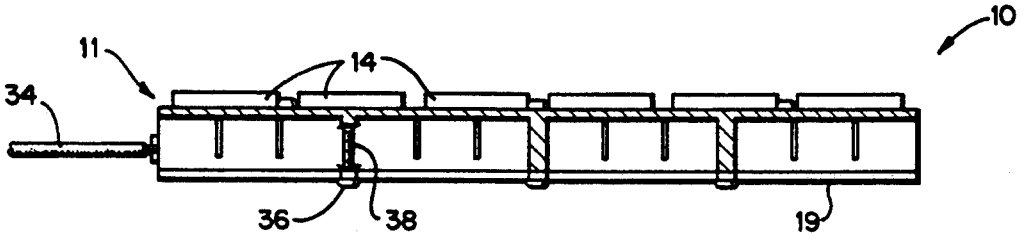
FIG. 3 is a side view of the module of FIG. 2.
Figure 4:
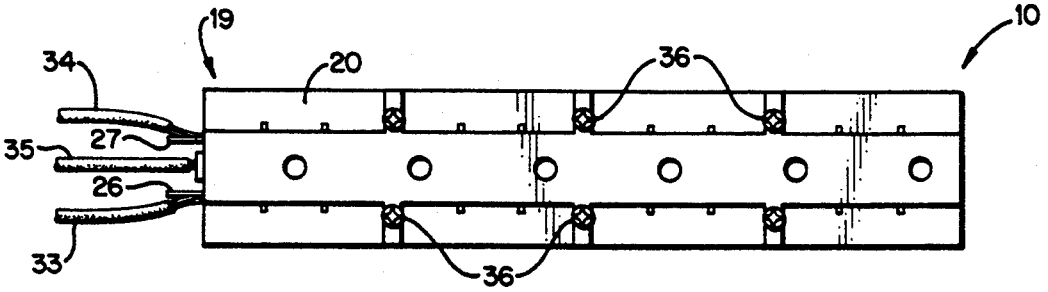
FIG. 4 is a bottom view of the module of FIGS. 2 and 3.

An exemplary module according to the present invention is shown generally by reference numeral 10 in FIGS. 1 through 6. The module 10 includes a first integral molded component (e.g. injection molded of a suitable plastic such as ABS) 11, of electrical insulating material, having a top face 12 defining a plurality of series of a electrical plug receiving openings disposed in line in a first direction 13. That is a plurality of electrical outlet receptacles 14 are formed, disposed in line, each receptacle defining at least two, but preferably three, openings, that is openings 15 through 17 for receipt of negative, positive, and ground electrical plug prongs.

The module 10 also comprises a second integral molded component 19 of electrical insulating material, e.g. injection molded of the same plastic as the first component 11. The second molded component has a flat bottom face 20 (see FIG. 4), a flat top face 21 and it has a length in the first direction 13 approximately the same as the length of the first component 11 (see FIGS. 2 and 3 in particular).

Another component of the module 10 is a plurality of bus bars 23, 24, and 25. One bus bar 23 through 25 is provided for each of the openings 15 through 17, and each bus bar 23 through 25 cooperates with all of the openings of one type of the entire top component 11. That is the negative bus bar 23 cooperates with all of the openings 15, the positive bus bar 24 cooperates with all of the openings 16, and the ground bus bar 25 cooperates with all of the openings 17. The bus bars 23 through 25 are of electrically conducting material, such as formed from strips of conductive metal like brass, copper, aluminum, or the like. The bus bars 23 through 25 have an end portion of each, 26 through 28, respectively, which is adapted to extend outwardly from one end of the components 11, 19 (or at least be accessible therefrom), the ends 26 through 28 having surface manifestations, such as openings 29 through 31 respectively, for connection to wires 33–35 of an electrical cord.

The final components of the module 10 are means for securing the components 11, 19 together, holding the bus bars 23 through 25 in a fixed position with respect to the plug receiving openings 15 through 17. Such securement preferably takes the form of a plurality (e.g. six as illustrated in FIGS. 1, 3, 4, and 5) of threaded fasteners (screws) 36 which extend through through-extending openings 37 (see FIG. 1) in the second component 19, into internally screw threaded openings 38 (see FIG. 3) in the top component 11.

The module 10 components 11, 19 also include integral positioning projections for positively positioning the bus bars 23 through 25 in a fixed position with respect to the plug receiving openings 15 through 17. These projections may take the form of downwardly extending wall components 40 (see FIGS. 1 and 5) associated with the upper module 11, and upstanding hollow projections (typically parallelepiped in shape) 42 extending upwardly from the top face 21 of the second component 19. Note that the ground bus 25 has means defining openings 44 therein which are shaped, and spaced from each other, to correspond to the parallelepiped projections 42 so that the openings 44 receive the projections 42, being positively held in position thereby.

Figure 6:
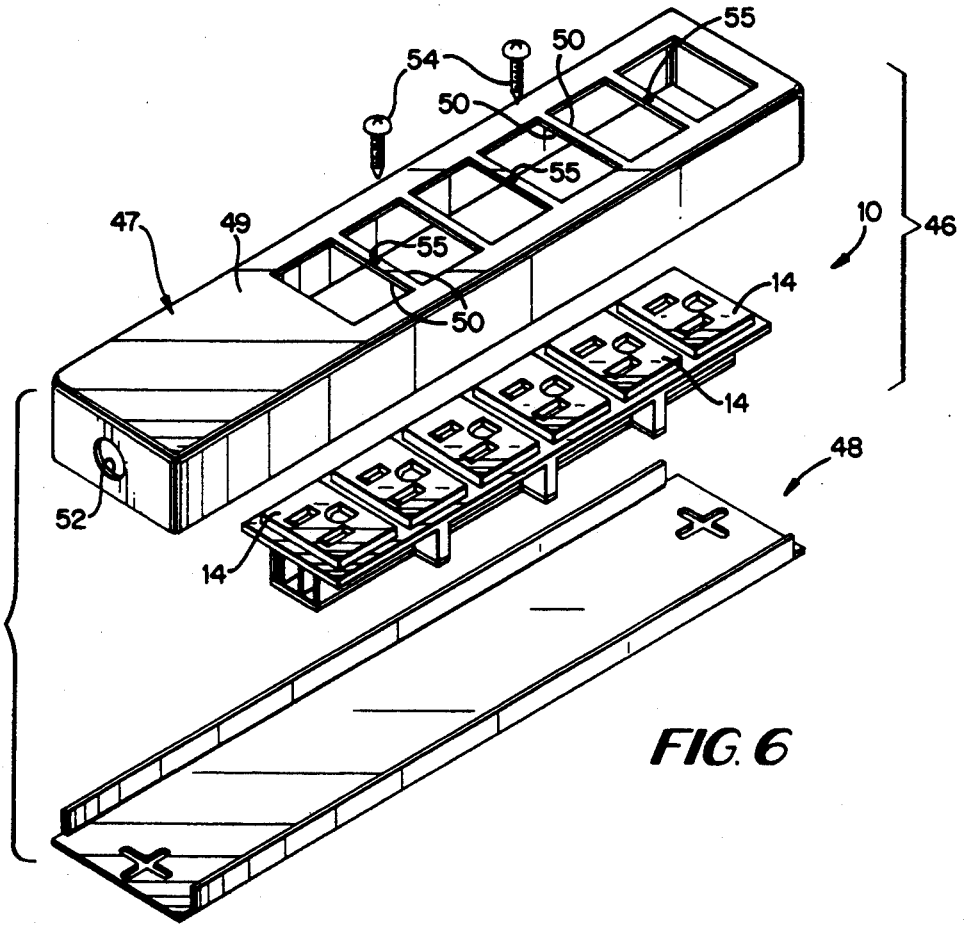
FIG. 6 is a top perspective exploded view of a multiple electrical outlet strip according to the invention utilizing the module of FIGS. 1 through 5.

The module 10 is a part of a multiple electrical outlet strip, the entire multiple electrical outlet strip being shown generally by reference numeral 46 in FIG. 6. The multiple electrical outlet strip 46 includes a top casing portion 47, and a bottom casing portion 48. The top casing portion 47 has an upper surface 49 with means defining a plurality of openings 50 in line therein. The openings 50 are sized, and spaced, from each other so that they receive the electrical outlet receptacles 14 of the module 10 therein, the receptacles 14 extending outwardly through the openings 50 as in a conventional multiple electrical outlet strip.

The casing top portion 47 also has means defining an opening 52 in one end thereof for passage of an electrical cord (containing the wires 33 through 35), not shown, therethrough. The bottom component 48 may be attached by screws, or by any other conventional manner, to the casing top portion 47. The casing portions 47, 48 may be made of any suitable material, such as metal, or plastic, but desirably both are made of metal (e.g. steel).

Connecting means are provided for connecting the module 10 to the upper surface 49 of the top portion 47 of the casing. Such connecting means preferably comprise a plurality of screws 54, or like threaded fasteners, which pass through through-extending openings 55 in the upper surface 49 of the top portion 47 of the casing, and into internally threaded screw receiving openings 56 (see FIG. 2) in the module 10 upper face 12.

Utilizing the structure illustrated in FIGS. 1 through 6, it is a simple and inexpensive task to assemble a multiple electrical outlet strip 46, yet the component parts are positively held in place, and the casing top and bottom components 47, 48 may be made of metal, and the bottom casing component 48 may be flat (i.e. be free of projections). All that is necessary to assemble the multiple electrical outlet strip 46 is to: insert the bus bars 23 and 24 into association with the internal projections 40 of the top component 11 of the module 10, insert the paralellepiped projections 42 through the openings 44 in the bus bar 25, bring the bottom component 19 of the module 10 into engagement with top component 11, and attach the module together with the screws 36 passing through the openings 37 into the openings 38. The wires 33 through 35 (part of a cord which has been passed through the opening 52) are connected to the openings 29 through 31 in the exposed ends 26 through 28 of the bus bars 23 through 25, then the module 10 is pushed up into contact with the upper face 49 of the casing top component 47. The electrical outlet receptacles 14 extend through the openings 50, and the screws 54 pass through openings 55 into internally threaded openings 56 to hold the module 10 in positive position with respect to the casing upper portion 47. Then the casing bottom portion 48 is used to close off the bottom of the casing upper portion 47 and is attached thereto in a conventional manner. The casing top and bottom portions 47, 48 thus contain the module 10 completely within it, with the electrical outlet receptacles 14 extending through the openings 50 and being able to have electrical plugs inserted into contact therewith.

Additional electrical components, such as surge arresters, line conditioners, and the like, can also be provided in the casing 47, particularly that portion thereof between the first of the openings 50 and the end of the casing top portion 47 having the opening 52 therein.

It will thus be seen that according to the present invention a simple and easy to construct module, and a simple and easy to construct multiple electrical outlet strip, which can have the casing components thereof made of any material, and which positively hold the module in place, have been provided. While the,invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A module for use in a multiple electrical outlet strip, comprising:

a first integral molded component of electrically insulating material having a top face defining a plurality of series of electrical plug receiving openings disposed in line in a first direction;

a second integral molded component of electrically insulating material having a bottom face, and a top face opposite said bottom face, and having a length, in said first direction, approximately as long as said first molded component;

a plurality of bus bars of electrically conducting material disposed between said first and second molded components, cooperating with said electrical plug receiving openings, each bus bar having an end termination accessible from the exterior of one end of said molded components in said first direction;

means for securing said first and second molded components together, holding said bus bars in a fixed position with respect to said plug receiving openings;

means associated with said first integral molded component for connecting said module to an upper surface of a casing for a multiple electrical outlet strip, comprising a plurality of screw receiving openings formed in said top face of said first molded component;

said plurality of bus bars comprising three bus bars, negative, positive, and ground bus bars; and a plurality of integral hollow projections formed on said second molded component and extending upwardly from the top face thereof, and wherein said ground bus bar has means defining a plurality of openings therein for receipt of said hollow projections, said projections stabilizing the position of said ground bus bar.

2. A module as recited in claim 1 wherein said first and second molded components are injection molded of plastic.

3. A module as recited in claim 1 wherein said bus bars are brass.

4. A module as recited in claim 1 wherein said hollow projections are parallelepipeds.

5. A module as recited in claim 1 further comprising integral positioning projections formed on said first molded component for positively positioning said bus bars in fixed position with respect to said plug receiving openings.

6. A module as recited in claim 5 wherein each of said plurality of series of electrical plug receiving openings comprises three openings, one each for positive, negative, and ground electrical plug prongs; and comprises three bus bars, negative, positive, and ground bus bars.

7. A module as recited in claim 6 wherein said securing means comprise a plurality of threaded fasteners extending though said bottom face of said second molded component and engaging said first molded component.

8. A multiple electrical outlet strip, comprising:

a casing including a casing top portion, and a casing bottom portion, said casing top portion having an upper surface with means defining a plurality of in line openings, each receiving an electrical outlet receptacle, for receipt of an electrical plug therein;

said electrical outlet receptacles comprising a module which comprises: a first integral molded component of electrically insulating material having a top face defining a plurality of series of electrical plug receiving openings disposed in line in a first direction; a second integral molded component of electrically insulating material having a bottom face, and a top face opposite said bottom face, and having a length, in said first direction, approximately as long as said first molded component; a plurality of bus bars of electrically conducting material disposed between said first and second molded components, cooperating with said electrical plug receiving openings, each bus bar having an end termination at one end of said molded components in said first direction; and means for securing said first and second molded components together, holding said bus bars in a fixed position with respect to said plug receiving openings;

connecting means for connecting said module to said upper surface of said casing, said casing top and bottom portions completely containing said module therewithin, with said electrical outlet receptacles extending outwardly from said casing top portion supper surface;

said plurality of bus bars comprising three bus bars, negative, positive, and ground bus bars; and a plurality of integral hollow projections formed on said second molded component and extending upwardly from the top face thereof, and wherein said ground bus bar has means defining a plurality of openings therein for receipt of said hollow projections, said projections stabilizing the position of said ground bus bar.

9. A strip as recited in claim 8 wherein said connecting means comprise a plurality of externally threaded fasteners, means defining a plurality of openings in said casing top portion upper surface, and means defining a plurality of aligned internally screw threaded openings in said module.

10. A multiple electrical outlet strip as recited in claim 8 wherein each of said plurality of series of electrical plug receiving openings comprises three openings, one each for positive, negative, and ground electrical plug prongs; and comprises three bus bars, negative, positive, and ground bus bars.

11. A module as recited in claim 8 wherein said hollow projections are parallelepipeds.

12. A module for use in a multiple electrical outlet strip, comprising:

a first integral molded component of electrically insulating material having a top face defining a plurality of series of electrical plug receiving openings disposed in line in a first direction;

a second integral molded component of electrically insulating material having a bottom face, and a top face opposite said bottom face, and having a length, in said first direction, approximately as long as said first molded component;

a plurality of bus bars of electrically conducting material disposed between said first and second molded components, cooperating with said electrical plug receiving openings, each bus bar having an end termination accessible from the exterior of one end of said molded components in said first direction;

means for securing said first and second molded components together, holding said bus bars in a fixed position with respect to said plug receiving openings;

means associated with said first integral molded component for connecting said module to an upper surface of a casing for a multiple electrical outlet strip, comprising a plurality of screw receiving openings formed in said top face of said first molded component;

integral positioning projections formed on said first molded component for positively positioning said bus bars in fixed position with respect to said plug receiving openings;

wherein integral positioning projections formed on said first molded component for positively positioning said bus bars in fixed position with respect to said plug receiving openings; and wherein said bus bars have portions thereof that extend outwardly from one end of said first and second molded components, and have surface manifestations associated with said outwardly extending portions for receipt of wires from an electrical cord.

13. A module as recited in claim 12 further comprising a plurality of integral hollow projections formed on said second molded component and extending upwardly from the top face thereof, and wherein said ground bus bar has means defining a plurality of openings therein for receipt of said hollow projections, said projections stabilizing the position of said ground bus bar.

14. A module for use in a multiple electrical outlet strip, comprising:

a first integral molded component of electrically insulating material having a top face defining a plurality of series of electrical plug receiving openings disposed in line in a first direction;

a second integral molded component of electrically insulating material having a bottom face, and a top face opposite said bottom face, and having a length, in said first direction, approximately as long as said first molded component;

negative, positive and ground bus bars of electrically conducting material disposed between said first and second molded components, cooperating with said electrical plug receiving openings, each bus bar having an end termination accessible from the exterior of one end of said molded components in said first direction;

means for securing said first and second molded components together, holding said bus bars in a fixed position with respect to said plug receiving openings; and a plurality of integral hollow projections formed on said second molded component and extending upwardly from the top face thereof; and wherein said ground bus bar has means defining a plurality of openings therein for receipt of said hollow projections, said projections stabilizing the position of said ground bus bar.

15. A module as recited in claim 14 wherein said hollow projections are parallelepipeds.

16. A module for use in a multiple electrical outlet strip, comprising:

a first integral molded component of electrically insulating material having a top face defining a plurality of series of electrical plug receiving openings disposed in line in a first direction;

a second integral molded component of electrically insulating material having a bottom face, and a top face opposite said bottom face, and having a length, in said first direction, approximately as long as said first molded component;

a plurality of bus bars of electrically conducting material disposed between said first and second molded components, cooperating with said electrical plug receiving openings, each bus bar having an end termination at one end of said molded components in said first direction;

means for securing said first and second molded components together, holding said bus bars in a fixed position with respect to said plug receiving openings; and means associated with said first integral molded component for connecting said module to an upper surface of a casing for a multiple electrical outlet strip, comprising a plurality of screw receiving openings formed in said top face of said first molded component.

17. A multiple electrical outlet strip, comprising:

a casing including a casing top portion, and a casing bottom portion, said casing top portion having an upper surface with means defining a plurality of in line openings, each receiving an electrical outlet receptacle, for receipt of an electrical plug therein;

said electrical outlet receptacles comprising a module which comprises: a first integral molded component of electrically insulating material having a top face defining a plurality of series of electrical plug receiving openings disposed in line in a first direction; a second integral molded component of electrically insulating material having a bottom face, and a top face opposite said bottom face, and having a length, in said first direction, approximately as long as said first molded component; a plurality of bus bars of electrically conducting material disposed between said first and second molded components, cooperating with said electrical plug receiving openings, each bus bar having an end termination at one end of said molded components in said first direction; and means for securing said first and second molded components together, holding said bus bars in a fixed position with respect to said plug receiving openings; and connecting means for connecting said module to said upper surface of said casing, said casing top and bottom portions completely containing said module therewithin, with said electrical outlet receptacles extending outwardly from said casing top portion upper surface.

* * * * *